US007780334B2

(12) United States Patent
Fung

(10) Patent No.: US 7,780,334 B2
(45) Date of Patent: Aug. 24, 2010

(54) LAMP FOR A DECORATIVE LIGHT STRING

(75) Inventor: Ronald King Yiu Fung, Kowloon (HK)

(73) Assignee: Packway Industries Limited, Kwun Tong, Kowloon (HK)

( * ) Notice: Subject to any disclaimer, the term of this patent is extended or adjusted under 35 U.S.C. 154(b) by 166 days.

(21) Appl. No.: 12/212,762

(22) Filed: Sep. 18, 2008

(65) Prior Publication Data

US 2010/0067242 A1 Mar. 18, 2010

(51) Int. Cl.
*H01R 33/00* (2006.01)

(52) U.S. Cl. ..... 362/654; 362/311.02; 362/800; 362/806

(58) Field of Classification Search ..... 362/249.02, 362/311.02, 652–654, 800, 806
See application file for complete search history.

*Primary Examiner*—Jason Moon Han
(74) *Attorney, Agent, or Firm*—Leydig, Voit & Mayer, Ltd.

(57) ABSTRACT

A lamp for a decorative light string includes an LED received within a translucent cover and mounted in a fixture including a cover holder and base which are mutually connected. The cover is received in the cover holder and electrical cables are secured to the base. The cover holder is, in turn, received in the base in a manner allowing simple and reliable electrical connection between the post and anvil of the LED and the conductors of the cable. The cover is elongate and has a closed end defining a concave/convex lens portion. Ribs are provided on the cover for connection to the cover holder and an internal shoulder in the cover is provided for abutting the LED.

8 Claims, 5 Drawing Sheets

LAMP FOR A DECORATIVE LIGHT STRING

TECHNICAL FIELD

The present invention relates to an electrical lamp, and more particularly to a lamp which may be used in a decorative light string.

BACKGROUND OF THE INVENTION

Decorative light strings are used to illuminate trees, buildings, and the like and include a plurality of lamps fixed along an electrical supply cable. The lamps conventionally comprise incandescent mini bulbs mounted in fixtures and electrically connected in parallel to the supply cable. These lamps consume substantial quantities of electrical power and are generally unreliable, requiring frequent replacement of the bulbs. It will therefore be understood that there is a need for an improved lamp which addresses these drawbacks.

DISCLOSURE OF THE INVENTION

According to one aspect of the present invention there is provided a lamp for a decorative light string, the lamp including:

a cover moulded from a transparent polymer, the cover being elongate and substantially symmetrical about a central longitudinal axis, the cover having first and second longitudinally opposing ends, the first end having a smooth, convex external surface, the second end having a cylindrical external surface;

a longitudinally extending recess in the cover, the recess having a concave closed end adjacent the first end, an open mouth at the second end and an elongate inner wall between the open and closed ends;

an intermediate external surface joining the convex external surface at the first end to the cylindrical external surface at the second end, the intermediate surface intersecting tangentially with the convex external surface at the first end;

an inwardly projecting circumferential shoulder formed in an inner wall of the recess intermediate the first and second ends;

an LED received in the recess, the LED having a post and an anvil elongated to extend through the open mouth, the LED having a case of a shape complementary to the recess for longitudinal sliding movement therein and sized such that a tip of the LED abuts the shoulder, and a fixture for securing the LED and cover to electrical cables, the fixture having a first cylindrical recess in which the cylindrical external surface at the second end is received.

Preferably the intermediate external surface is frusto-conical, tapering inwardly in the longitudinal direction from a broad section at the intersection with the cylindrical external surface at the second end.

Preferably the concave/convex portion of the cover at the first end forms a positive meniscus lens portion and a plurality of ribs protrude from the cylindrical external surface, the ribs extending parallel to the axis.

Preferably the fixture includes first and second parts, wherein the first cylindrical recess is provided in the first part, the first part includes first and second openings receiving the anvil and post respectively, a bend is formed in both the post and anvil where adjacent an end of the first and second openings, the second part includes a through-extending aperture receiving the first part, electrical contacts fixed in the second part, with electrical cables fixed to the contacts.

Preferably the first and second parts are moulded from polymer and each includes an integral protrusion, a first of the protrusions including a neck terminating in an enlarged head, the neck defining a flexible hinge, the second protrusion defining a recess having a narrow mouth and adapted to receive the neck when the first protrusion is bent about the hinge such that the neck is retained by resilient action and head abuts a face of the second protrusion to restrain relative movement between the first and second parts.

Preferably the protrusions project substantially in a radial direction.

Preferably the first part includes an axially elongated stem having concavities on opposing sides thereof in which a portion of the electrical cables are received.

This invention provides an LED lamp which is effective and efficient in operational use, which may be economically constructed and has an overall simple design which minimizes manufacturing costs and maximizes performance.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
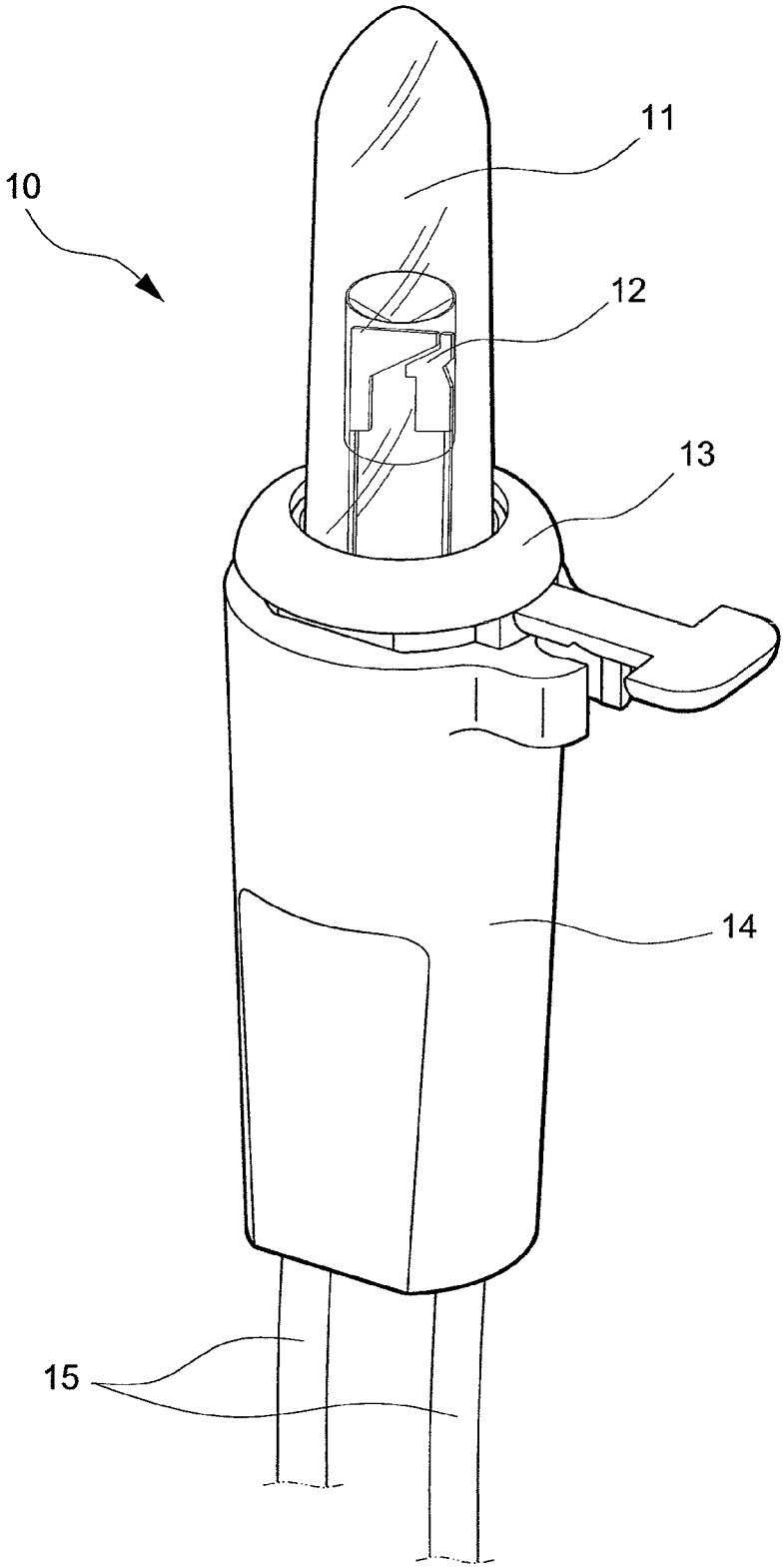
FIG. 1 is a perspective view of a preferred embodiment of a lamp according to the invention.
Figure 2:
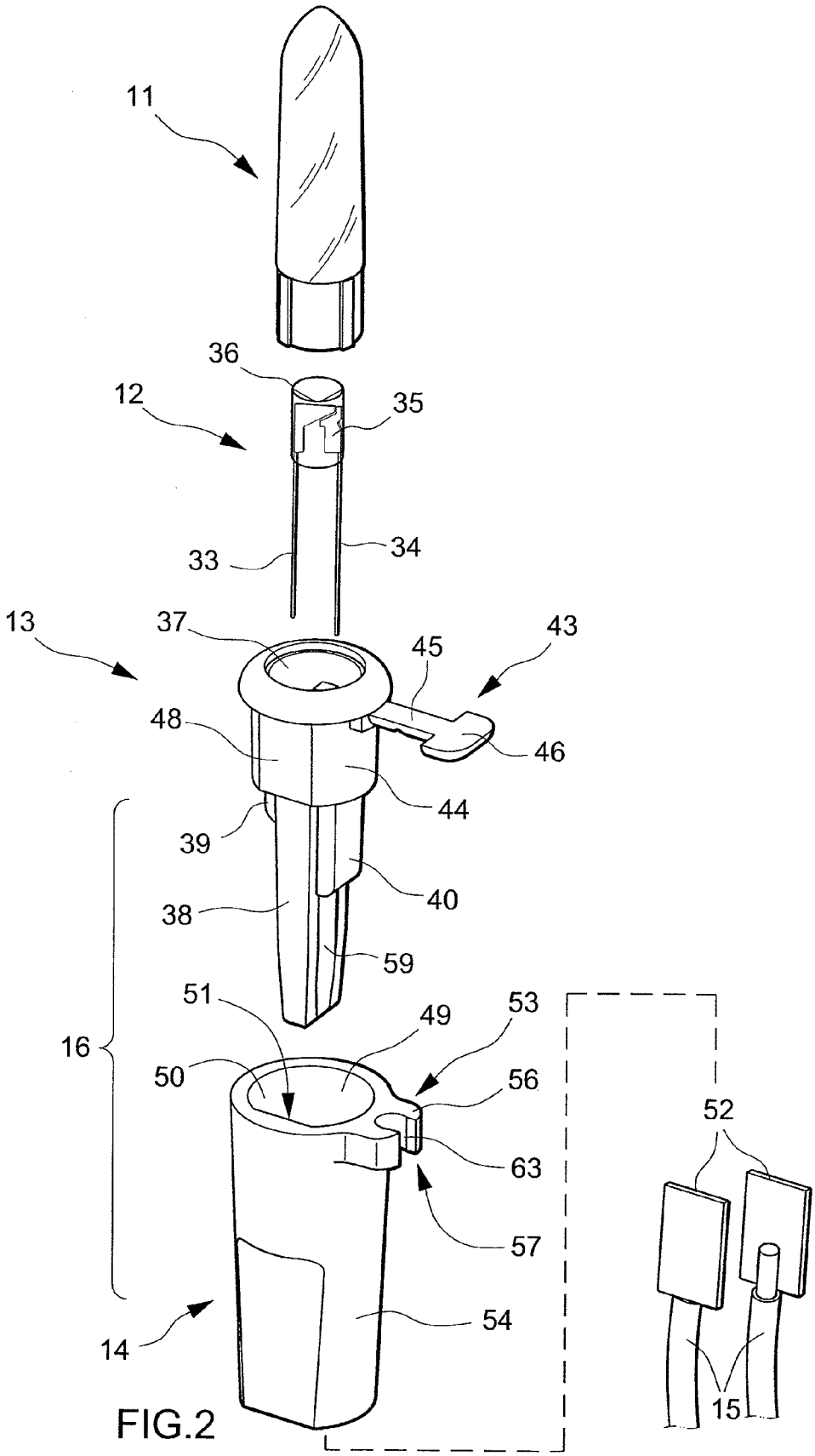
FIG. 2 is an exploded view of the lamp of FIG. 1.

Referring to FIGS. 1 and 2, the lamp 10 includes a transparent cover 11 in which a light emitting diode (LED) 12 is received and a fixture 16 assembled from a cover holder 13 and a base 14, in which the cover holder 13 is received. In use the fixture 16 is secured to electrical cables 15 to form a decorative light string (not shown).

Figure 3:
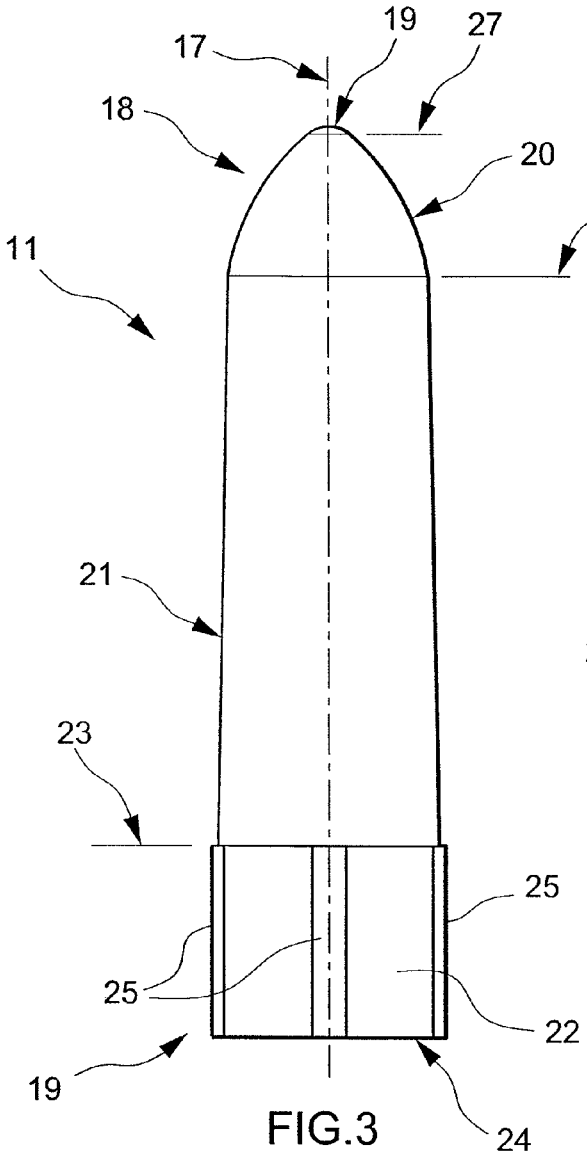
FIG. 3 is a side view of a cover of the lamp of FIG. 1.
Figure 4:
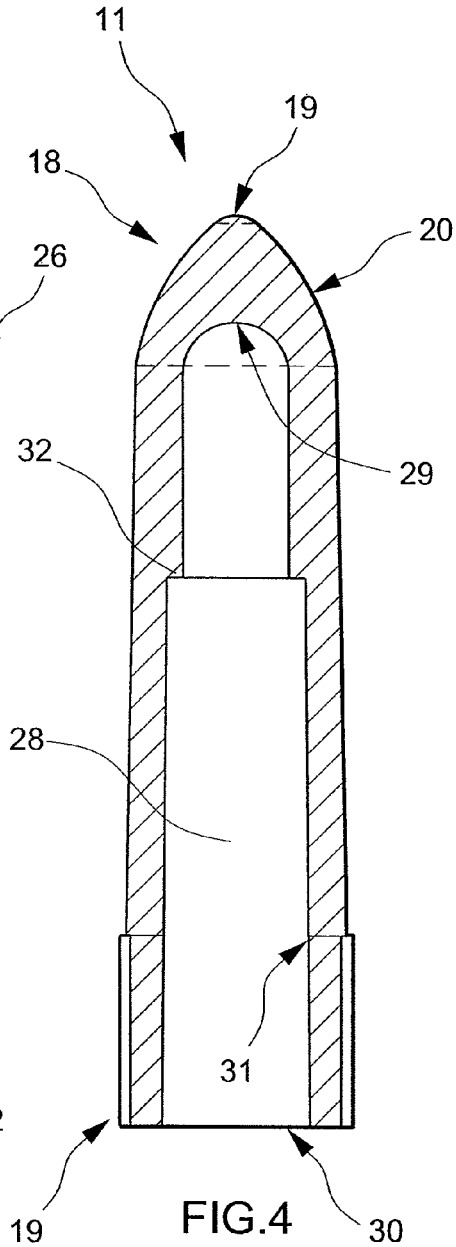
FIG. 4 is a central longitudinal section through the cover of FIG. 3.
Figure 5:
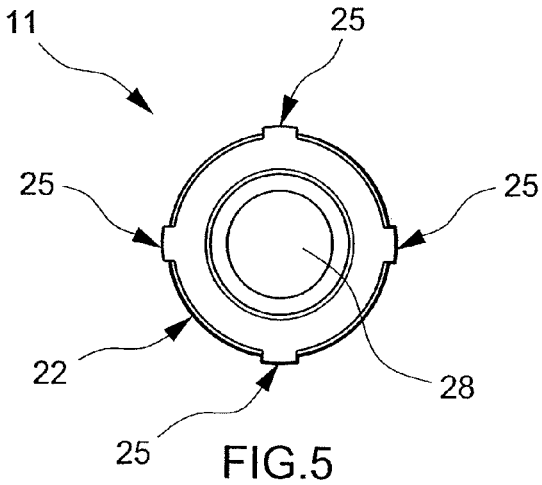
FIG. 5 is an end view of the cover of FIG. 3.

As shown in FIGS. 3-5, the cover 11 is elongate and substantially symmetrical about a central longitudinal axis 17, having first and second longitudinally opposing ends 18, 19. As used herein, the term "axial" refers to a direction substantially parallel to the axis 17. The term "radial" refers to a direction substantially orthogonal to the axis 17. The term "circumferential" refers to the direction of a circular arc having a radius substantially orthogonal to the axis 17.

The first end has a smooth, convex external surface comprising a spheriodal tip surface portion 19 that is tangentially joined to the adjacent transition surface portion 20. A frusto-conical intermediate external surface 21 joins the convex external surface 19, 20 at the first end 18 to a cylindrical external surface 22 at the second end 19. The frusto-conical surface 21 intersects tangentially with the transition surface portion 20 and tapers inwardly in the longitudinal direction at an angle of 1° from a broad section at the intersection plane 23, where the frusto-conical surface 21 intersects with the cylindrical external surface 22. The cylindrical external surface 22 extends axially between the transverse plane 23 and the planar face 24 at the second end 19. Four equally circumferentially spaced ribs 25 protrude from the cylindrical surface 22 and extend parallel to the axis 17. The transverse plane 26 defines the intersection between the frusto-conical surface 21 and transition surface portion 20, while transverse plane 27 defines the intersection between the transition surface portion 20 and the spheriodal tip surface portion 19.

An axially extending recess 28 has a concave closed end 29 adjacent the first end 18 and an open mouth 30 at the second end 19. The spheriodal tip surface portion 19 has a radius of curvature larger than the radius of curvature of the concave closed end 29, this the concave/convex portion of the cover thereby forming a positive or convergent meniscus lens portion. The recess 28 has an elongate frusto-conical inner wall 30 extending between the open and closed ends 29, 30. A circumferential shoulder 32 formed in the inner wall projects inwardly and is positioned intermediate the first and second ends 18, 19. The cover 11 is moulded from a translucent polymer, preferably clear or coloured polystyrene.

Figure 6:
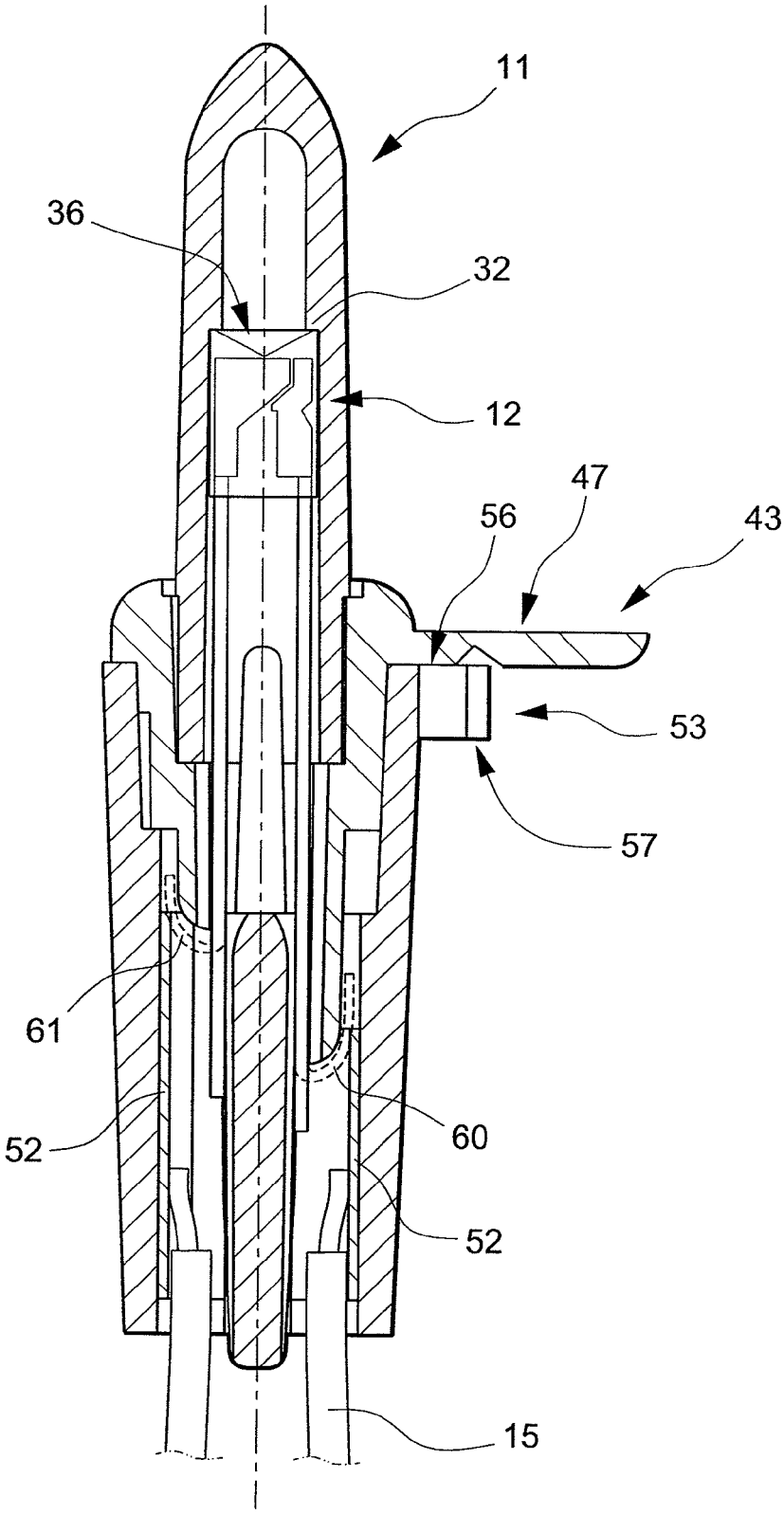
FIG. 6 is a central longitudinal section through the lamp of FIG. 1.

As shown in FIG. 6, the packaged LED 12 has an elongate anvil and post 33, 34 and a case having a cylindrical surface 35 and a transversely aligned annular face 36 at its outer tip. The LED may produce white or coloured light and has a wide viewing angle.

The LED 12 is received in the recess 28 with the post and anvil extending through the open mouth 30. The cylindrical surface 35 of the case of a shape is sized to allow longitudinal sliding movement in the recess 28. The annular face 36 abuts the shoulder 32 to locate the LED 12 during assembly, as described below.

The cover holder 13 and base 14 are both moulded from a polymer having a degree of resilience, such as polyethylene. The cover holder 13 has an axially aligned first cylindrical recess 37 in which the cylindrical external surface 22 of the cover 11 is received. A tight interference fit is provided between the cover 11 and cover holder 13, and the ribs 25 cooperate with the cylindrical recess 37 to restrain relative rotation about the axis 17.

Figure 8:
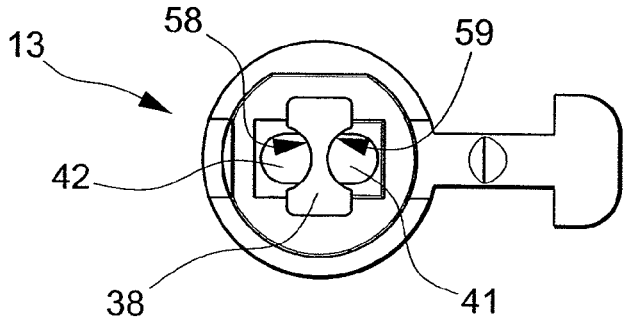
FIG. 8 is an end view of the first fixture part of FIG. 2.

Referring to FIGS. 2 and 8, the cover holder 13 further includes an axially elongated stem 38 with shoulders 39, 40 on transversely opposite sides thereof. The end of the stem 38 includes axially elongated concavities 58, 59 on transversely opposite sides thereof. The first part includes first and second through-extending, axially aligned openings 41, 42 for receiving the anvil and post respectively. The cover holder 13 includes an integral protrusion 43 extending substantially in a radial direction from an outer face 44. The face 44 extends axially concentric with axis 17 and partly circumferentially to intersect with a flat 48. The protrusion 43 has a neck 45 terminating in an enlarged head 46. A waist transverse to the neck 45 defines a flexible hinge.

The base 14 has an axial through-extending aperture 49 for receiving the cover holder 13, the opening 49 having faces 50, 51 for engaging the face 44 and flat 48 respectively. Electrical contacts 52 are soldered to the conductors of the cables 15 and fixed, as by an interference fit in the base 14 on opposing sides of the aperture 49. The base 14 includes an integral protrusion 53 extending substantially in a radial direction from an outer face 54. The second protrusion 53 defines a recess 55 having a mouth 63 opening in the radial direction. The protrusion 53 has an outer and inner transversely aligned faces 56 and 57, with face 56 disposed adjacent the protrusion 43.

Figure 7:
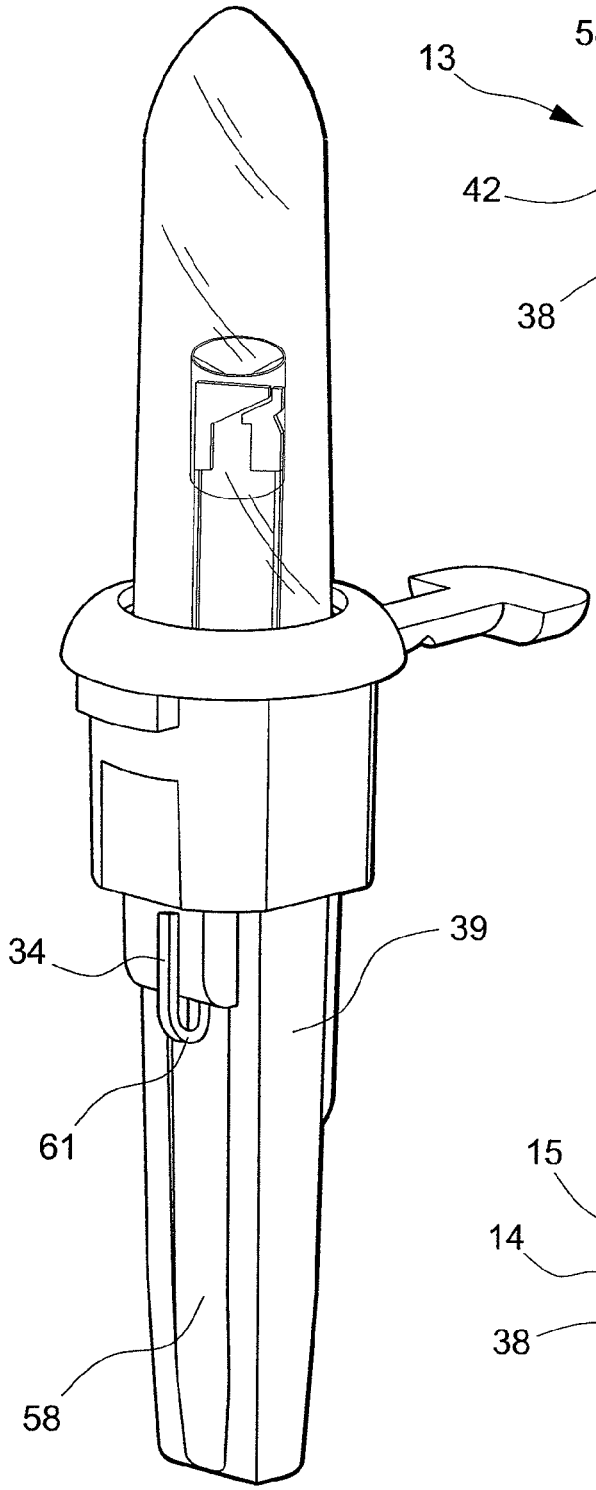
FIG. 7 is a side view of the cover, first fixture part and LED of the lamp of FIG. 2 assembled together.
Figure 9:
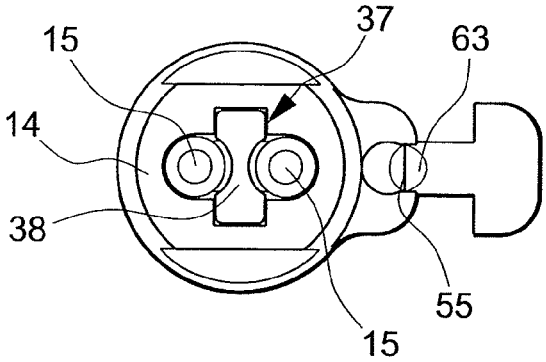
FIG. 9 is an end view of the lamp of FIG. 1.

The lamp 10 is assembled by inserting the LED 12 into the cover 11, until the annular face 36 abuts the shoulder 32, then entering the anvil and post 33, 34 into the openings 41, 42 a U-bend 60, 61 is then formed in both the post and anvil turning them back upon themselves to overly the shoulders 39, 40 adjacent the inner end of the first and second openings 41, 42, as shown in FIG. 7. The cover holder 13 is then entered axially into the aperture 49 in the base 14, bringing the post and anvil into contact with the electrical contacts 52, while the cables 15 are received in the concavities 58, 59.

The protrusions 43, 53 provide couplings for restraining relative axial movement between the cover holder 13 and base 14. By bending the protrusion 43 about the hinge or waist 47 the neck 45 may be pressed through mouth 63 with some elastic deformation such that the neck 45 is thereby retained in the recess 55 by resilient action. In this position the head 46 abuts the inner face 57 of the second protrusion 53 to restrain relative axial movement between the cover holder 13 and base 14.

Aspects of the present invention have been described by way of example only and it should be appreciated that modifications and additions may be made thereto without departing from the scope thereof.

The invention claimed is:

1. A lamp for a decorative light string, the lamp comprising:

a cover of a transparent polymer, the cover being elongate and substantially symmetrical about a central longitudinal axis, the cover having first and second longitudinally opposing ends, the first end having a smooth, convex external surface, the second end having a cylindrical external surface;

a longitudinally extending recess in the cover, the recess having a concave closed end adjacent the first end, an open mouth at the second end and an elongate inner wall between the open and closed ends;

an intermediate external surface joining the convex external surface at the first end to the cylindrical external surface at the second end, the intermediate surface intersecting tangentially with the convex external surface at the first end;

an inwardly projecting circumferential shoulder located in an inner wall of the recess, intermediate the first and second ends;

a light emitting diode (LED) received in the recess, the LED having a post and an anvil elongated to extend through the open mouth, the LED having a case with a shape complementary to the recess for longitudinal sliding movement in the recess and sized such that a tip of the LED abuts the shoulder, and a fixture for securing the LED and to cover to electrical cables, the fixture having a first cylindrical recess in which the cylindrical external surface at the second end is received.

2. The lamp of claim 1 wherein the intermediate external surface is frusto-conical, tapering inwardly in the longitudinal direction from a broad section where the intermediate external surface intersects the cylindrical external surface at the second end.

3. The lamp of claim 1 wherein the first end defines a positive meniscus lens portion and including a plurality of ribs protruding from the cylindrical external surface, the ribs extending parallel to the axis.

4. The lamp of claim 1 wherein the fixture includes first and second parts, the first cylindrical recess is located in the first part, the first part includes first and second openings receiving the anvil and the post, respectively, both of the post and the anvil include a bend adjacent an end of the first and second openings, the second part includes a through-extending aperture receiving the first part, electrical contacts are fixed in the second part, and electrical cables are fixed to the contacts.

5. The lamp of claim 4 wherein the first and second parts are a polymer and each of the first and second parts includes an integral protrusion, a first of the protrusions including a neck terminating in an enlarged head, the neck defining a flexible hinge, a second of the protrusions defining a recess having a narrow mouth for receiving the neck when the first of the protrusions is bent about the hinge such that the neck is retained by resilient action and the head abuts a face of the second of the protrusions to restrain relative movement between the first and second parts.

6. The lamp of claim 5 wherein the protrusions project substantially in a radial direction.

7. The lamp of claim 6 wherein the first part includes an axially elongated stem having concavities on opposing sides of the first part and in which portions of the electrical cables are received.

8. The lamp of claim 7 wherein the intermediate external surface is frusto-conical, tapering inwardly in the longitudinal direction from a broad section where the intermediate external surface intersects the cylindrical external surface at the second end, and the cover, at the first end, includes a positive meniscus lens.

* * * * *